United States Patent [19]

Fujimura et al.

[11] Patent Number: 4,717,325

[45] Date of Patent: Jan. 5, 1988

[54] SPINNERET ASSEMBLY

[75] Inventors: Isao Fujimura, Moriyama; Taiju Terakawa, Shiga, both of Japan

[73] Assignee: Chisso Corporation, Ohsaka, Japan

[21] Appl. No.: 614,015

[22] Filed: May 25, 1984

[30] Foreign Application Priority Data

Jun. 1, 1983 [JP] Japan ..... 58-97285

[51] Int. Cl.[4] ..... D01D 13/00

[52] U.S. Cl. ..... 425/131.5; 264/171; 425/133.1

[58] Field of Search ..... 264/171, DIG. 26; 425/131.5, 133.1

[56] References Cited

U.S. PATENT DOCUMENTS

| | | | |
|---|---|---|---|
| 2,931,091 | 4/1960 | Breen | 425/131.5 |
| 2,987,797 | 6/1961 | Breen | 264/171 |
| 3,459,846 | 8/1969 | Matsui et al. | 425/131.5 |
| 3,526,571 | 9/1970 | Ogata | 264/DIG. 26 |
| 3,559,237 | 2/1971 | Biggelaar et al. | 264/171 |
| 3,584,339 | 6/1971 | Kamachi et al. | 425/131.5 |
| 3,613,170 | 10/1971 | Soda et al. | 425/131.5 |
| 3,778,208 | 12/1973 | Bisset et al. | 425/131.5 |
| 4,406,850 | 9/1983 | Hills | 425/131.5 |
| 4,445,833 | 5/1984 | Moriki et al. | 425/131.5 |

*Primary Examiner*—Jay H. Woo
*Assistant Examiner*—Timothy W. Heitbrink
*Attorney, Agent, or Firm*—Fay, Sharpe, Beall, Fagan, Minnich & McKee

[57] ABSTRACT

A spinneret assembly for sheath-and-core type composite fibers capable of corresponding to various spinning conditions, with a small degree of eccentricity of core component and a small quality variance and provided densely with a large number of spinning holes is provided, which assembly comprises a cap having two spinning liquid reservoirs for core component liquid and sheath component liquid partitioned by a partition wall; a filter; a first distribution plate having introducing holes for alternately distributing the liquids into subsequent distribution grooves; a second distribution plate having on its back surface, straight distribution grooves prepared by cutting in parallel and also having on its flat front surface, perforated liquid pressure control holes for leading the distributed liquids to a subsequent spinneret plate; a spinneret plate having on its flat back surface, perforated spinning holes having the common axes to the core component pressure control holes of the second distribution plate; and a spacer for forming a narrow clearance between the second distribution plate and the spinneret plate; the respective core component pressure control holes being located at a point of intersection of two diagonals of a square or rectangle formed by adjacent four sheath component pressure control holes.

16 Claims, 4 Drawing Figures

SPINNERET ASSEMBLY

BACKGROUND OF THE INVENTION

This invention relates to a spinneret assembly for subjecting two kinds of spinning liquids to composite spinning into composite fibers of sheath-and-core type.

Heretofore, a number of spinneret assemblies for producing composite fibers of sheath-and core type have been proposed, and a representative example thereof is disclosed in U.S. Pat. No. 2,987,797. According to the patent, the spinneret assembly is characterized in that it consists of a spinneret plate having spinning holes, and a back plate opposed thereto, with not so narrow a space being placed between these plates; a sheath component is distributed through the space over the whole of the spinneret; and the sheath component is radially introduced through the respective relatively narrow zones surrounding the respective inlets of spinning holes formed by circular flat projections provided concentric with the spinning holes on at least one of the plates.

The structure of such a spinneret assembly is readily applicable to a spinneret having a relatively small number of spinning holes sparsely arranged. However, if it is intended to densely arrange a large number of spinning holes, many manhours are required for precise cutting processing for providing the above circular projections, this resulting in a very expensive apparatus. Moreover, if the intervals between the spinning holes are narrowed, it may be practically impossible in some case to ensure room for providing the projections. Even if spinning holes are arranged at the points of intersection of square lattice, the minimum pitch is at least about 4 mm; hence it is difficult to raise the density of the spinning holes up to five holes/cm$^2$ or more. Further, the spinneret of such a structure enables the sheath component to uniformly flow in the spinning holes from their periphery with the passage resistance of the sheath component caused by the above narrow zone; hence if the width of the ring-form projections is narrowed in order to densely arrange the spinning holes, the clearance between the spinneret plate and the back plate in the narrow zone must be made narrower. Thus, contaminative matters or gel-like substances contained in the spinning liquids are liable to clog in this clearance during spinning and hence obstruct a smooth flow of the sheath component to thereby make difficult a stable and long term spinning. Moreover, the above projections on the surface of the spinneret plate or the back plate are liable to be injured during cleaning or assembling operation thereof, which make the life of spinneret short. Thus the above structure have raised various problems.

An object of the present invention is to provide a spinneret assembly capable of spinning composite fibers which have a superior uniformity of fineness of single filaments, no composite unevenness and superior concentric properties, for a long term and in a stabilized manner, and also capable of corresponding to broad spinning conditions for various kinds of fiber raw materials. Another object of the present invention is to provide a spinneret assembly which is simple in structure and very easy in work, has a large number of spinning holes arranged over the whole surface of spinneret and also has a high productivity.

In view of the afore-mentioned present status of conventional spinnerets of sheath-and-core type composite fiber provided with a number of spinning holes, the present inventors have made extensive research, and as a result have found that when a spinneret assembly of a specific structure is devised, it is possible to make a spinneret assembly of composite fiber by an easy work and economically, which assembly can generally correspond to spinning conditions of various kinds of polymers; can reduce the degree of eccentricity of the core component; can reduce quality variation between single filaments; can reduce lapse of time; and can be provided with a large number or spinning holes close to each other.

SUMMARY OF THE INVENTION

The present invention resides in a spinneret assembly for composite fibers of sheath-and-core type which comprises;

a cap wherein spinning liquid reservoirs for receiving a spinning liquid for a core component and a spinning liquid for a sheath component are respectively provided in front and rear (or on the left and right sides) of a partition wall;

a filter for filtering the spinning liquids at the exit of the recervoirs;

a first distribution plate having introducing holes for alternately distributing two kinds of spinning liquids passed through the filter into corresponding distribution grooves described later, which plate also functions as a filter-supporting body;

a second distribution plate having on the back surface thereof straight distribution grooves prepared by cutting the surface in parallel and at equal intervals in the front and rear (of left and right) directions, and also having on a flat surface as the front surface thereof pressure control holes perforated in the plate, for leading the spinning liquids distributed by the distribution grooves to a spinneret plate described later;

a spinneret plate having a flat surface as the back surface thereof through which spinning holes are perforated so that the respective axes of the spinning holes can be common to those of the core component pressure control holes in the second distribution plate; and a specer for forming a narrow and uniform clearance between the second distribution plate and the spinneret plate;

the respective sheath component pressure control holes perforated through the front surface of the second distribution plate being arranged so as to occupy the point of intersection of a square or rectangular lattice formed by the respective adjacent four of the holes, and the respective core component pressure control holes being arranged so as to occupy the point of intersection of two diagonals of said square or rectanglular lattice.

DETAILED DESCRIPTION OF THE PREFERRED EMBODIMENTS

Figure 1:
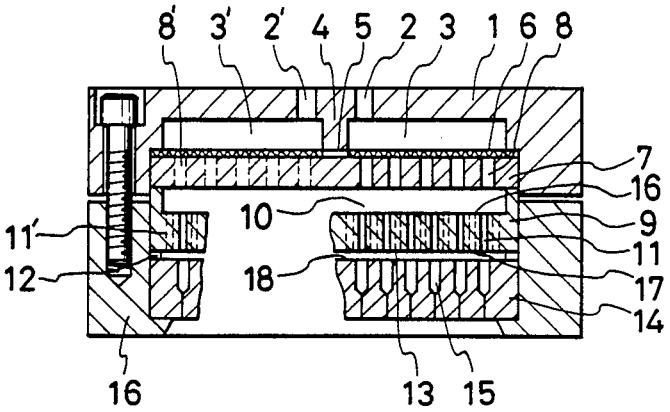
FIG. 1 shows a cross-sectional view (cut away in part) of an embodiment of the spinneret assembly of the present invention.
Figure 2:
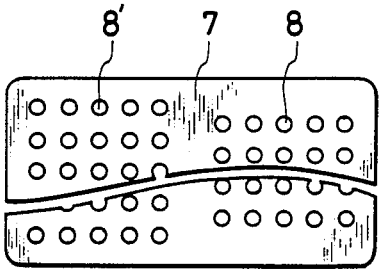
FIG. 2 shows the back surface view of a first distribution plate 7.

An embodiment of the present invention will be described below referring to the accompanying drawings.

A spinneret assembly shown in Figures comprises;

a cap 1 wherein spinning liquid reservoirs 3, 3' for receiving a spinning liquid for a core component and a spinning liquid for a sheath component are respectively provided in front and rear (or on the left and right sides) of a partition wall 4;

a filter 6 for filtering the spinning liquids at the exit of the reservoir 3, 3';

a first distribution plate 7 having introducing holes 8, 8' for alternately distributing two kinds of spinning liquids passed through the filter 6 into corresponding, distribution grooves 10, 10' described later, which plate also functions as a filter-supporting body;

a second distribution plate 9 having on the back surface thereof 16 straight distribution grooves 10, 10' prepared by cutting the surface in parallel and at equal intervals in the front and rear (or left and right) directions, and also having on a flat surface as the front surface 17 thereof pressure control holes 11, 11' perforated in the plate, for leading the spinning liquids distributed by the distribution grooves to a spinneret plate 14 described later;

a spinneret plate 14 having a flat surface as the back surface 18 thereof through which spinning holes 15 are perforated so that the respective axes of the spinning holes 15 can be common to those of the core component pressure control holes 11 in the second distribution plate; and a spacer 12 for forming a narrow and uniform clearance between the second distribution plate 9 and the spinneret plate 14;

the respective sheath component pressure control holes 11' perforated through the front surface 17 of the second distribution plate being arranged so as to occupy the point of intersection of a square or rectangular lattice formed by the respective adjacent four of the holes, and the respective core component pressure control holes 11 being arranged so as to occupy the point of intersection of two diagonals of said square or rectangular lattice.

Figure 3:
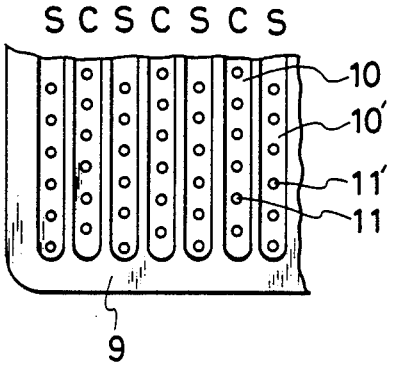
FIG. 3 shows the back surface view (in part) of a second distribution plate 9.
Figure 4:
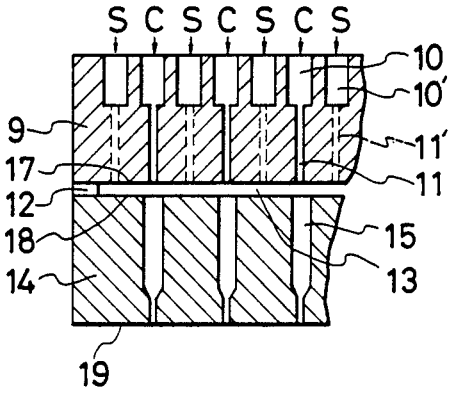
FIG. 4 shows a cross-sectional view (in part) illustrating the relationship among the second distribution plate 9, a spacer 12 and a spinneret plate 14.

A core component (designated as "C") and a sheath component (designated as "S") are led via inflow holes 2, 2' into the respective spinning liquid reservoirs 3, 3' partitioned by a partition wall 4, pass through a filter 6 having a separation band 5, and reach a first distribution plate 7. This plate is provided with core component-introducing holes 8 and sheath component-introducing holes 8' for distributing and feeding the corresponding components into straight core component-distributing grooves 10 and sheath component-distributing grooves 10' prepared on the back surface 16 of a second distribution plate 9 by cutting the surface substantially in parallel and at equal intervals, which plate also functions as a filter-supporting body. In the second distribution plate 9, the core component-distributing grooves 10 and the sheath component-distributing grooves 10' are alternatively located, and the first row and the ultimate row of these grooves are both applied to the sheath component-distributing grooves 10' (see FIGS. 3 and 4).

The core component and the sheath component both fed via the first distribution plate 7 into the respective distribution grooves are passed through core component pressure control holes 11 and sheath component pressure control holes 11' both prepared by perforating the respective bottoms of the distribution grooves, and then discharged from the front surface 17 of the second distribution plate 9 into a narrow zone 13. On the front surface 17 of the second distribution plate 9, the sheath component pressure control holes 11' are arranged so as to occupy the points of intersection of a square or rectangular lattice, and the core component pressure control holes 11 are arranged so as to occupy the point of intersection of two diagonals of the above square or rectangular lattice formed by adjacent four sheath component pressure control holes.

A spacer 12 is intervened between the second distribution plate 9 and a spinneret plate 14 to form a narrow zone 13. In the spinneret plate 14, spinning holes 15 are perforated so as to correspond to the core component pressure control holes 11 in the second distribution plate 9 and have the common axes to the holes 11. The core component discharged from the core component pressure control holes 11 is wrapped in the sheath component discharged from the sheath component pressure control holes 11' and fulfilled in the narrow zone 13, during which the core component flows in the spinning holes 15 and extruded therefrom for spinning.

A first specific feature of the present invention is that any of the distribution plate 7, the second distribution plate 9 and the spinneret plate 14 are made only by straight groove-cutting work and/or perforation work, and the back surfaces and the front surfaces of these plates are flat without any projection parts or grooves of complicated shape. As such a structure is employed, it is possible to make a spinneret assembly having a large number of spinning holes arranged therein with a high density, and yet economically by a relatively simple work and with a superior precision. Further, the spinneret assembly thus made is insensible to injuries, has a long lifetime and does not always require any close attention when it is handled. It is possible to render the density of spinning holes 5 holes/$cm^2$ or higher.

A second specific feature of the present invention is that neither projections nor grooves are provided on the front surface 17 of the second distribution plate 9 and on the back surface 18 of the spinneret plate 14 to form a flat structure; and in the second distribution plate 9, the sheath component pressure control holes 11' are arranged so as to occupy the points of intersection of a square or rectangular lattice, and also the core component pressure control holes 11 are arranged so as to occupy the point of intersection of two diagonals of the square or rectangular lattice formed by adjacent four sheath component pressure control holes; and further, the spinning holes 15 are arranged so as to have the common axes to the core component pressure control holes 11. As such a structure is employed, it is possible to provide a much extended narrow zone 13; hence it is possible to broadly set up the clearance of the zone (the clearance between the front surface 17 of the second distribution plate 9 and the back surface 18 of the spinneret plate 14), whereby the narrow zone 13 is not clogged by contaminating matters, and a stable and long term operation is possible. Further, the sheath component pressure control holes 11' are arranged so as to surround any of the core component pressure control holes 11 (and hence the spinning holes 15) at equally distant locations; thus due to such an arrangement in cooperation with the flow-adjusting effect of the above extended narrow zone 13, the sheath component flows in the spinning holes in such a manner that the sheath component wraps the core component therein in a uniform thickness, whereby it is possible to obtain composite fibers of sheath-and-core type the core component of which has a small degree of eccentricity.

A third specific feature of the present invention is that the clearance of the narrow zone 13 is variable and it is possible to optionally vary the clearance by exchanging the spacer 12. In the case of composite spinning of sheath-and-core type, it has generally been necessary to reduce the clearance of the narrow zone as the viscosity of the sheath component polymer decreases, and to increase the clearance as the viscosity increases. Further, this clearance must have been set to an optimum value on the basis of various spinning conditions such as the kind and combination of polymers used as the core component and the sheath component, spinning temperature, extruding amount, etc.; thus in the case of conventional spinneret assemblies having a fixed clearance of narrow zone, it has been necessary to employ other spinneret assemblies when these conditions are varied. In the spinneret assembly of the present invention, by exchanging the spacer 12 which can be cheaply made, it is possible to easily and optionally adjust the clearance of the narrow zone 13 and it is also possible to cause one spinneret assembly to correspond to various spinning conditions; hence the spinneret assembly of the present invention is very economical.

What we claim is:

1. A spinneret assembly for composite fibers of the sheath-and-core type, comprising:

means forming a core liquid reservoir and a separate sheath liquid reservoir;

a first distribution plate having a plurality of parallel through introducing holes, with a first plurality of said introducing holes being in fluid communication with said core liquid reservoir and a second plurality of said introducing holes being in fluid communication with said sheath liquid reservoir;

a second distribution plate being parallel to said first distribution plate;

said first and second distribution plates having means forming therebetween a plurality of parallel separate grooves, with a first plurality of said grooves in fluid communication with said first plurality of introducing holes on the side of said first distribution plate opposite from said core liquid reservoir and a second plurality of said grooves in fluid communication with said second plurality of introducing holes on the side of said second distribution plate opposite from said sheath liquid reservoir;

said second distribution plate having a plurality of through core liquid pressure control holes communicating on one side with said first plurality of grooves and further having a plurality of through sheath liquid pressure control holes communicating on one side with said second plurality of grooves;

a spinning plate spaced from and parallel to said second distribution plate, and having a fixed pattern of a plurality of through spinning holes coaxial in pairs with said core liquid pressure control holes, respectively;

said second distribution plate and said spinning plate having adjacent flat parallel unobstructed surfaces interrupted only by said holes and forming therebetween a narrow continuous mixing zone for combining said core liquid and sheath liquid; and said sheath liquid pressure control holes entering into said mixing zone in a fixed pattern so as to be equally spaced around adjacent core liquid distribution holes.

2. The spinneret assembly according to claim 1, including a flat sheet of filter material being supported on said first distribution plate to cover all of said holes in said first distribution plate and thereby filter both the core liquid and the sheath liquid in respective portions of said filter.

3. A spinneret assembly according to claim 2, wherein said means forming said reservoirs comprises a cap having two chamber portions separated by a partition wall and respectively closed by said filter and first distribution plate.

4. A spinneret assembly according to claim 3, wherein said grooves are formed by a continuous flat surface of one of said distribution plates, and a plurality of parallel separate open grooves cut in the other of said distribution plates, which open grooves are closed by the adjacent flat surface of said one distribution plate.

5. The spinneret assembly according to claim 4, wherein spacer means are provided between said second distribution plate and said spinning plate for adjusting the spacing between said second distribution plate and said spinning plate and correspondingly adjusting the mixing zone to compensate for variations in core liquid and sheath liquid characteristics.

6. A spinneret assembly according to claim 5, wherein the sheath liquid pressure control holes are parallel bores arranged in a rectangular lattice, and said core liquid pressure control holes are parallel bores arranged in a rectangular lattice arranged so as to respectively occupy the point of intersection of two diagonals of an adjacent four sheath liquid control holes that are formed in a square.

7. The spinneret assembly according to claim 5, wherein said grooves are arranged so that there are two outside grooves that are sheath liquid containing grooves, and said sheath liquid containing grooves and core liquid containing grooves alternate with each other to provide opposite sides of each core liquid containing groove with immediately adjacent sheath liquid containing grooves; and said core liquid pressure control holes being parallel bores arranged in a fixed pattern, and said core liquid pressure control holes being parallel bores arranged in a fixed pattern so that a line perpendicular to said grooves and intersecting sheath liquid pressure control holes of adjacent sheath liquid grooves will generally bisect the space between two adjacent core liquid pressure control holes in the same core liquid groove that is between said last mentioned sheath liquid containing grooves.

8. The spinnert assembly according to claim 1, wherein said grooves are formed by a continuous flat surface of one of said distribution plates, and a plurality of parallel separate open grooves cut in the other of said distribution plates, which open grooves are closed by the adjacent flat surface of said one distribution plate.

9. The spinneret assembly according to claim 8, wherein spacer means are provided between said second distribution plate and said spinning plate for adjusting the spacing between said second distribution plate and said spinning plate and correspondingly adjusting the mixing zone to compensate for variations in core liquid and sheath liquid characteristics.

10. The spinneret assembly according to claim 9, wherein the sheath liquid pressure control holes are parallel bores arranged in a rectangular lattice, and said core liquid pressure control holes are parallel bores arranged in a rectangular lattice arranged so as to respectively occupy the point of intersection of two diagonals of an adjacent four sheath liquid control holes that are formed in a square.

11. The spinneret assembly according to claim 9, wherein said grooves are arranged so that the two outside grooves are sheath liquid containing grooves, and said sheath liquid containing grooves and core liquid containing grooves alternate with each other to provide each core liquid containing groove with sheath liquid containing grooves immediately adjacent its opposite sides; and said core liquid pressure control holes being parallel bores arranged in a fixed pattern, and said core liquid pressure control holes being parallel bores arranged in a fixed pattern so that a line perpendicular to said grooves and intersecting sheath liquid pressure control holes of adjacent sheath liquid grooves will generally bisect the space between two adjacent core liquid pressure control holes in the same core liquid groove that is between said last mentioned sheath liquid containing grooves.

12. The spinneret assembly according to claim 1, wherein spacer means are provided between said second distribution plate and said spinning plate for adjusting the spacing between said second distribution plate and said spinning plate and correspondingly adjusting the mixing zone to compensate for variations in core liquid and sheath liquid characteristics.

13. The spinneret assembly according to claim 12, wherein the sheath liquid pressure control holes are parallel bores arranged in a rectangular lattice, and said core liquid pressure control holes are parallel bores arranged in a rectangular lattice arranged so as to respectively occupy the point of intersection of two diagonals of adjacent four sheath liquid control holes that are formed in a square.

14. The spinneret assembly according to claim 12, wherein said grooves are arranged so that the two outside grooves are sheath liquid containing grooves, and said sheath liquid containing grooves and core liquid containing grooves alternate with each other to provide each core liquid containing groove with sheath liquid containing grooves immediately adjacent its opposite sides; and said core liquid pressure control holes being parallel bores arranged in a fixed pattern, and said core liquid pressure control holes being parallel bores arranged in a fixed pattern so that a line perpendicular to said grooves and intersecting sheath liquid pressure control holes of adjacent sheath liquid grooves will generally bisect the space between two adjacent core liquid pressure control holes in the same core liquid groove that is between said last mentioned sheath liquid containing grooves.

15. The spinneret assembly according to claim 1, wherein the sheath liquid pressure control holes are parallel bores arranged in a rectangular lattice, and said core liquid pressure control holes are parallel bores arranged in a rectangular lattice arranged so as to respectively occupy the point of intersection of two diagonals of an adjacent four sheath liquid control holes that are formed in a square.

16. The spinneret assembly of claim 1, wherein said grooves are arranged so that the two outside grooves are sheath liquid containing grooves, and said sheath liquid containing grooves and core liquid containing grooves alternate with each other to provide each core liquid containing groove with sheath liquid containing grooves immediately adjacent its opposite sides; and said core liquid pressure control holes being parallel bores arranged in a fixed pattern, and said core liquid pressure control holes being parallel bores arranged in a fixed pattern so that a line perpendicular to said grooves and intersecting sheath liquid pressure control holes of adjacent sheath liquid grooves will generally bisect the space between two adjacent core liquid pressure control holes in the same core liquid groove that is between said last mentioned sheath liquid containing grooves.

* * * * *